US006394130B1

(12) United States Patent
Deininger

(10) Patent No.: US 6,394,130 B1
(45) Date of Patent: May 28, 2002

(54) CONTROL VALVE DEVICE

(75) Inventor: Horst Deininger, Alzenau (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/517,826

(22) Filed: Mar. 2, 2000

(30) Foreign Application Priority Data

Mar. 5, 1999 (DE) ..... 199 09 713

(51) Int. Cl.[7] ..... F15B 13/06

(52) U.S. Cl. ..... 137/596.12; 137/596.17; 137/884

(58) Field of Search ..... 137/596.12, 596.17, 137/884

(56) References Cited

U.S. PATENT DOCUMENTS 3,826,282 A * 7/1974 Noe ..... 137/625.69
3,960,166 A * 6/1976 Linser ..... 137/625.69 X
3,976,103 A * 8/1976 Ostic ..... 137/625.69

FOREIGN PATENT DOCUMENTS

DE 19716442 10/1998

* cited by examiner

*Primary Examiner*—Gerald A. Michalsky
(74) *Attorney, Agent, or Firm*—Webb Ziesenheim Logsdon Orkin & Hanson, P.C.

(57) ABSTRACT

A control valve device controls the movement of at least one hydraulic user. Relative movement of a control spool valve of a control valve with respect to a housing controls the connection of at least one hydraulic connection that is in communication with the user with a delivery connection and with a reservoir connection. The control spool valve can be moved relative to the housing by an actuator device. The housing has a multi-layer construction consisting of plates connected with one another by soldering or another adhesive, which plates comprise intermediate plates that are located between two end plates. The thickness (D) of the end plates is greater than the thickness (d) of the intermediate plates, whereby the end plates are provided with a fastening device for the actuator device and/or of connection devices for the hydraulic lines.

20 Claims, 5 Drawing Sheets

CONTROL VALVE DEVICE

BACKGROUND OF THE INVENTION

1. Field of the Invention

This invention relates to a control valve device to control the movement of at least one hydraulic user. Specifically, in the present invention, as a result of a relative movement of a control spool valve of a control valve with respect to a housing, the connection of at least one hydraulic connection that is in communication with the user with a delivery connection and with a reservoir connection can be controlled, the control spool valve can be moved relative to the housing by an actuator device, and the housing has a multi-layer construction consisting of plates that are connected to one another by an adhesive or an additional substance, which plates comprise intermediate plates that are located between two end plates.

2. Background Information

Control valve devices that control the flow of hydraulic fluid to and from a user can be control valves for the actuation of a single-action user, for example a lifting cylinder of an industrial truck, and control valves for the actuation of a double-action user, for example a tilting cylinder of an industrial truck. The actuation devices of the control spool valve can be mechanical, hydraulic, pneumatic or electrical actuation devices.

The housing of the control valve device of the present invention has a multi-layer construction of a plurality of plate-shaped sheets connected to one another by an adhesive or an additional substance, in particular by soldering, e.g., hard soldering or brazing. This construction significantly reduces the size and weight of the housing compared to cast housings.

A control valve device of the prior art with a housing that is soldered together from a plurality of plate-shaped sheets for the actuation of the work hydraulic system of an industrial truck is described in DE 197 16 442 A1. In this prior art control valve device, inside the housing there are corresponding recesses in the sheets to create a pump channel, a reservoir channel and corresponding hydraulic channels that lead to the users. For the connection of the pump channel to the delivery line of the pump, for the connection of the reservoir channel to a recirculation line and for the connection to the hydraulic channels of the hydraulic lines leading to the users, there are separate connection sockets or housing parts that must be connected with the housing. The actuator device can be a stepper motor or a proportional magnet, for example, a separate housing part which must be connected with the housing is necessary for the fastening of the actuator device of the control valves. The connection sockets of the delivery line and of the reservoir line are thereby soldered into the pump channel or the reservoir channel of the housing. If the independent housing parts are bolted to the housing, special thread inserts are required, which must be soldered into corresponding borings in the housing that are formed from recesses in a plurality of plates. The result, however, is a difficult, time-consuming and expensive manufacturing process, because the connection sockets and the thread inserts must be manufactured separately and must then be soldered into the housing in corresponding borings formed from recesses in a plurality of plates. In addition, a large number of parts are required as well as a correspondingly high amount of labor for the assembly of the plates and of the connection sockets and thread inserts for the soldering process.

The object of the invention is to make available a control valve device that can be constructed easily and quickly and is economical to manufacture.

SUMMARY OF THE INVENTION

The invention provides that the thickness of the end plates exceeds the thickness of the intermediate plates. The end plates are provided with a fastening device for the actuator device and/or one or more connection devices for the delivery line that is connected with the delivery connection, for the reservoir line that is connected with the reservoir connection, and/or for the hydraulic line that is connected with the hydraulic connection.

The end plates of the housing are thicker than the intermediate plates. Therefore, the connection devices required for the connection of the hydraulic line, the reservoir line and the delivery line can be provided on the end plates, as can the fastening device for the fastening of the actuator device. This arrangement results in a series of advantages.

Providing all the necessary connection devices for the corresponding lines and fastening devices for the actuator devices of the control valve device eliminates additional connection sockets and thread inserts that would have to be soldered in corresponding recesses in a plurality of plates of the housing. Therefore, the cost and time required for manufacture is reduced, as is the number of parts required, which reduces the time and cost of assembly. In addition, the thick end plates increase the rigidity of the housing. Pressurized channels can now be located in the outer portion of the housing. The thick end plates, as a result of their weight, act as weighting plates during the soldering process. During soldering joints between the plates are oriented in a horizontal plane. As a result, the plates are pressed together during the soldering with a defined force, and there are defined, uniformly thick layers of solder between the plates. This construction eliminates the use of fixing devices, e.g., separate weighting plates, or riveted fixing bars connected to the end plates, which were previously necessary in the soldering process on valve devices with a housing that consists of uniformly thick plates. This further reduces the time and cost of manufacturing and assembly.

In one configuration of the invention, the fastening device for the actuator device and/or the connection devices, for the delivery line, the reservoir line, and/or for the hydraulic line are each at least one threaded boring located in an end plate. With a threaded boring located in an end plate, it becomes possible to easily fasten or connect the actuator device, the delivery line, the reservoir line and the hydraulic line to the housing. In addition, the threaded borings can be introduced into the end plates before the soldering process. Consequently, the manufacture of the housing of the control valve device can be simplified.

In one embodiment, in which the control spool valve is located in a housing boring that is formed from recesses in the intermediate plates and in the end plates, little time or effort is required for the fastening of the actuator device if the threaded boring is located in a flange area of the actuator device that surrounds the recess in an end plate.

Some of the intermediate plates and at least one end plate are provided with recesses that are in communication with one another. As a result of the contour and the arrangement of the recesses with respect to one another, a pump channel, a reservoir channel and at least one hydraulic channel are formed. The delivery line, the reservoir line and the hydraulic line can be quickly and easily connected to the end plate and thus to the housing if the recesses located in the end plate are realized in the form of threaded borings. The recess thus forms a part of the corresponding hydraulic channel, whereby the corresponding line can be screwed into the threaded boring in the recess.

In one refinement of the invention, at least one end plate includes at least one fastening device for the fastening of the control valve device to a control valve support. The fastening device for fastening the control valve device to a valve support, such as a vehicle body, for example, is thereby located on the end plates, reducing time and effort required for manufacture and assembly. The fastening device can be located on the lateral surface of the end plate providing good accessibility for the fastening device. In addition, no additional space is occupied by the fastening device on the end surfaces of the end plates, on which the actuator devices and the connections of the lines are located.

A smaller number of parts and thus reduced time and cost of manufacture and assembly for the control valve device can be achieved if the device is shaped onto the end plate. The housing boring of the control spool valve may be closed on the side opposite the actuator element with a housing cover, whereby the end plate opposite the actuator device is provided with a fastening device for the housing cover. The fastening device of the housing cover is thereby provided on the corresponding end plate, whereby the housing boring can be closed in a simple manner.

The time and effort required for manufacture and assembly can be reduced if the fastening device for the housing cover is at least one threaded boring that is located in the end plate. For this purpose, the one part of the recess in the end plate that forms the housing boring can be a threaded boring, and the housing cover can be a screw plug. Alternatively, the housing cover can have a flange, whereby corresponding threaded borings can be provided in the end plate in the flange area of the housing cover.

In one embodiment of the invention, in which there is at least one additional hydraulic component, which is located in a concentrically located recess of some of the intermediate plates and at least one end plate, the time and effort required for manufacturing and assembly can be reduced if a fastening device is provided for the additional component on the end plate. The additional component can be, for example, a check valve for the leak-free isolation of the user, a neutral circulation valve, a pressure relief valve or a delivery flow sensor to detect the speed of movement of the user. The recess that is necessary for the installation of the component can be quickly and easily closed, or a pilot device of the component can be fastened to the end plate by a fastening device that is located on the end plate.

The recess in the end plate may be a threaded boring. In this case, the housing boring, for example of a check valve, can be easily and quickly closed by a screw plug. The fastening device can also be at least one threaded boring that is located in the flange area of the component in the end plate. The actuation device of a pilot valve, a pilot-controlled pressure relief valve or the sensor device of a delivery flow sensor, for example, can thereby be easily fastened to the end plate.

In one embodiment of the invention, in which the actuation device of the control spool valve is an electrical actuator device, in particular in the form of a stepper motor, there are particular advantages if the fastening device for the electrical actuator device is fastened to one end plate and the connection device for the delivery line that is in communication with the delivery connection, the connection device for the reservoir line that is in communication with the reservoir connection and the connection device for the hydraulic line that is in communication with the hydraulic connection are located on the opposite end plate. As a result of the arrangement of the electrical components and of the hydraulic components on opposite end plates, there is a clear spatial separation between the hydraulic and electrical lines that are connected to the control valve device.

If the additional component is an electrical component, in particular in the form of an electrical delivery flow sensor or an electrically actuated pressure relief valve, it is appropriate if the fastening devices are provided on the end plate that is provided with the fastening device of the actuator device of the control valve.

In one embodiment, the housing forms a control block for a first control spool valve and at least one additional control spool valve. As a result of the housing in the form of a laminated valve with a multi-layer construction, and the configuration of the end plates of the invention, the control block is small, easy and economical to manufacture.

On one end plate there may be a connection flange for the connection of a control valve to control an additional user, whereby the connection flange has one recess that is in communication with the pump channel and one recess that is in communication with the reservoir channel. In the vicinity of the connection flange there is at least one fastening device, which is a threaded boring, in the end plate. With a connection flange of this type on the control block, it is a simple matter to fasten a control valve by the fastening device for the actuation of an additional user. If an additional control valve is not provided, the recesses of the connection flange can be easily closed with a screw plug which is fastened in the fastening device.

There are advantages when a control valve device of the invention is used in a work machine, in particular an industrial truck, to actuate the hydraulic work system. The control valve device can be a control block with two control valves to actuate a lifting cylinder and a tilting cylinder of an industrial truck. As a result of the ability to connect an additional user to the connection flange, it is also possible to connect a control valve to actuate a lateral load-pushing device or a rotational unit of an industrial truck with little effort on the control block. As a result of the construction of the control block of the invention, the control block is cheaper and easier to manufacture and takes up less space in the industrial truck.

BRIEF DESCRIPTION OF THE DRAWINGS

Additional advantages and details of the invention are explained below with reference to the exemplary embodiment that is illustrated in the accompanying schematic figures, in which.

DETAILED DESCRIPTION OF THE PREFERRED EMBODIMENTS

Figure 1:
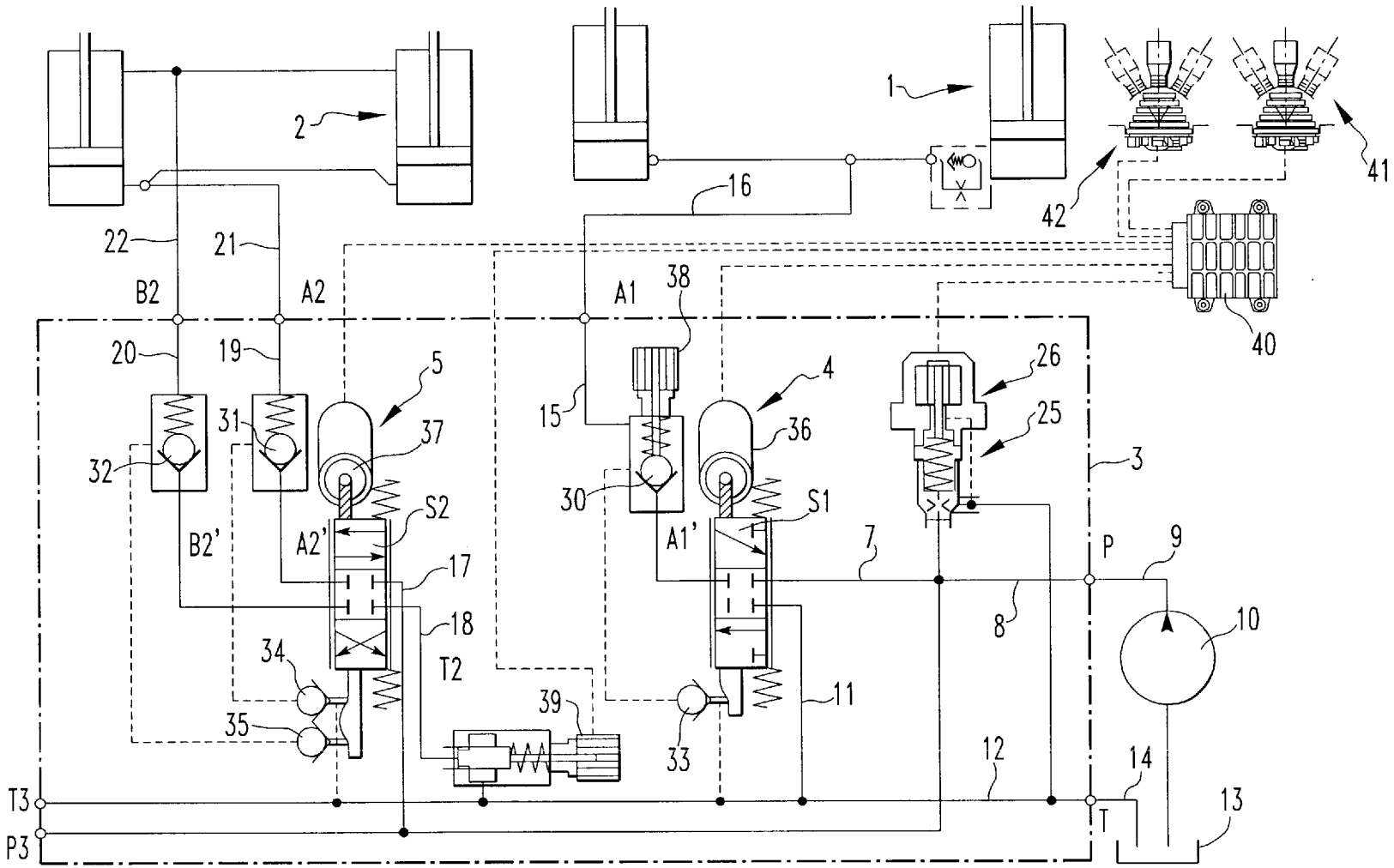
FIG. 1 is a schematic diagram of a valve device according to the present invention.
Figure 2:
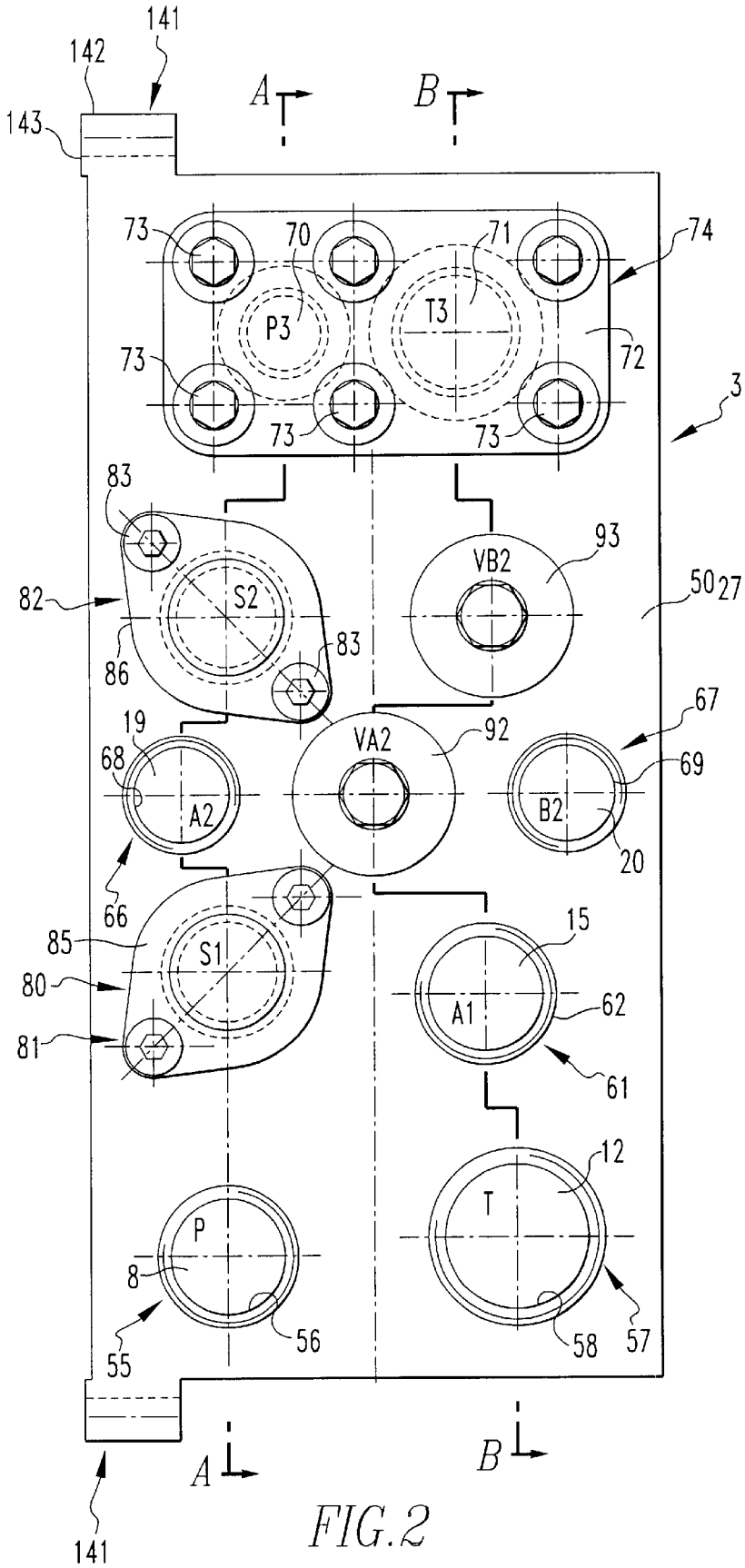
FIG. 2 is a plan view of one lateral surface of a valve device according to the present invention.

FIG. 1 shows the schematic diagram of a control valve device of the invention to control the movement of two users. For example, a user 1 is a single-action hydraulic cylinder, and a user 2 is a double-action hydraulic cylinder. In this case, the user 1 is a lifting cylinder, and the user 2 is a tilting cylinder on an industrial truck.

The control valve device has a housing 3 that is a control block, in which there are a control valve 4 to actuate the user 1 and an additional control valve 5 to actuate the user 2.

The control valve 4 is connected on the input side to a delivery branch channel 7 which is in communication with a delivery channel 8 formed in the housing 3. The delivery channel 8 is in communication on the housing 3 with a delivery line 9 of a pump 10 at a delivery connection P. An additional branch channel 11 leads from the control valve 4 to a reservoir channel 12 that is formed in the housing 3. The reservoir channel 12 is connected at the reservoir connection T with a reservoir line 14 that leads from the housing 3 to a reservoir 13. The connection of the delivery branch line 7 or the branch line 11 with a hydraulic channel 15 that is located in the housing 3 can be controlled by a connection A1' of the control valve 4. Hydraulic channel 15 is connected to a hydraulic line 16 that leads to the user 1 through a hydraulic connection A1 of the housing 3.

The control valve 5 is in communication by a delivery branch channel 17 with the delivery channel 8 and a branch channel 18 with the reservoir channel 12. Two hydraulic channels 19, 20 lead to the user 2, and are in communication with corresponding connections A2' and B2' of the control valve 6. The hydraulic channels 19, 20 lead to hydraulic connections A2, B2 of the housing 3, to each of which is connected a respective hydraulic line 21, 22 that leads to the user 2.

On the housing 3 there is an additional pump connection P3 and a reservoir connection T3, with which an additional control valve can be connected to the pump channel 8 and to the reservoir channel 12, and thus to the control block formed by housing 3. The control valves 4, 5 have a closed middle position, and the pump 10 is a constant flow pump. To control an unpressurized circulation of the delivery flow of the pump 10 when the control valves 4, 5 are not actuated, and to limit the maximum working pressure of the users 1, 2, there is a pilot-controlled pressure relief valve 25. The pressure relief valve 25 is connected on the input side to the delivery channel 8 and on the output side to the reservoir channel 12. The response pressure of the pressure relief valve 25 can be adjusted by an electrically actuated pilot valve 26.

For the leak-free isolation of the users 1, 2, in each of the hydraulic channels 15, 19 and 20 there are pilot-controlled check valves 30, 31, 32 with a differential piston surface and which can be moved into the open position by corresponding pilot valves 33, 34, 35 that are in the form of check valves. In this case, the pilot valve 33 can be actuated in the event of a corresponding actuation of the control valve 4. The pilot valves 34, 35 can be actuated in the event of a corresponding actuation of the control valve 5.

To actuate the control valves 4, 5, there are respective actuator devices 36, 37, which can be stepper motors, for example.

In addition, in the hydraulic channel 15, there is a delivery flow sensor 38 to measure the speed of movement of the user 1. The delivery flow sensor 38 can thereby be integrated into the check valve 30 and realized in the form of a delivery flow sensor that is active in both directions of flow. The speed of movement of the user 2 is measured by a delivery flow sensor 39 which is located in the branch line 18 that leads from the control valve 5 to the reservoir channel 12.

The electrical actuator devices 36, 37, the delivery flow sensors 38, 39 and the pilot valve 26 of the pressure relief valve 25 are in communication with an electronic control device 40. The electronic control device 40 is in communication on the input side with a setpoint control device 41 for the user 1 and a setpoint control device 42 for the user 2. By way of example, the setpoint control devices 41, 42 in this case are realized in the form of joysticks. The electronic control device 40 can also be in communication with a drive motor, which is not illustrated, to control the speed of rotation of the pump 10.

Figure 3:
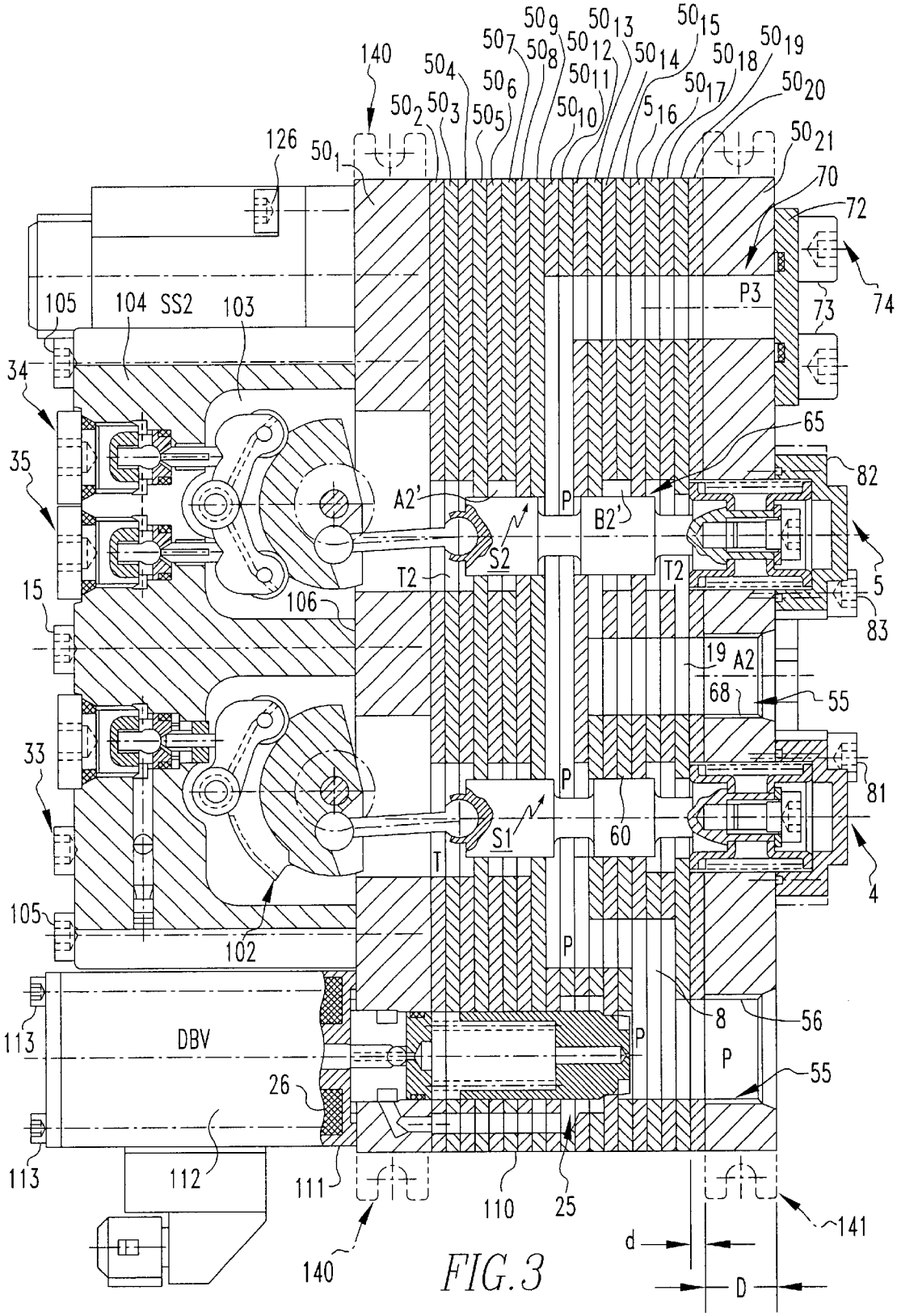
FIG. 3 is a sectional view taken along Line A—A in FIG. 2.
Figure 4:
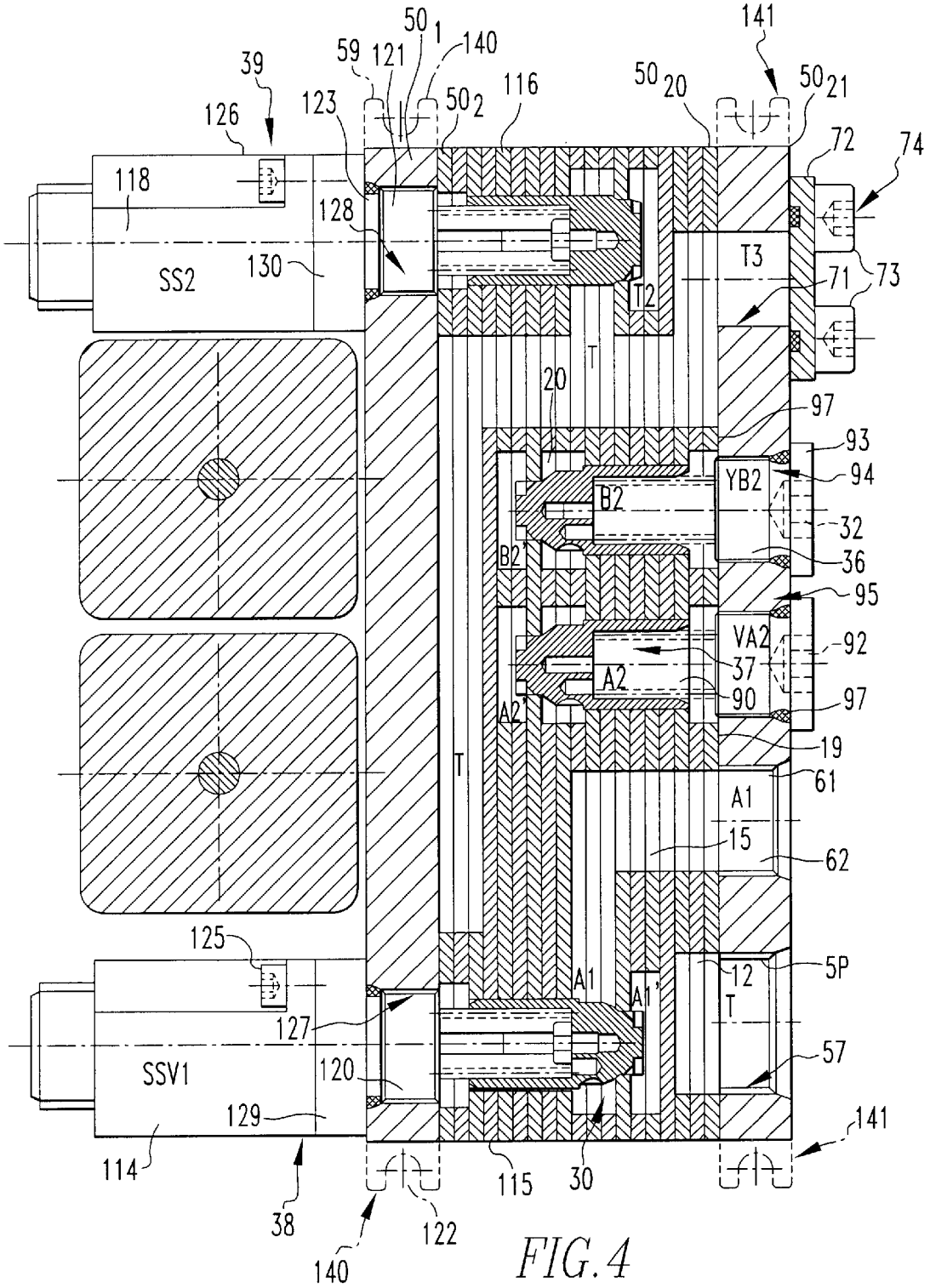
FIG. 4 is a sectional view taken along Line B—B in FIG. 2.
Figure 5:
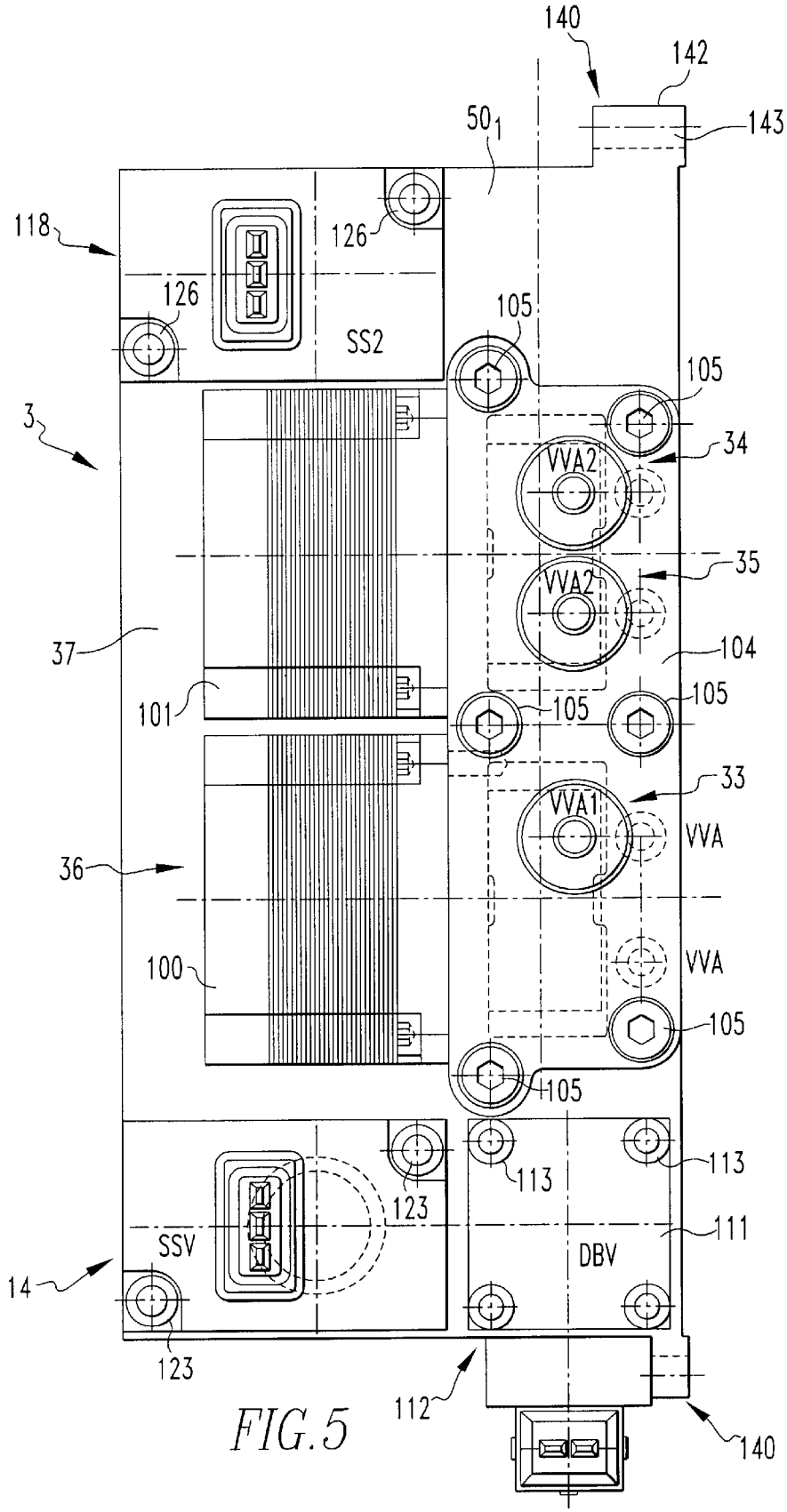
FIG. 5 is a plan view of a second lateral surface of the valve device according to the present invention.

FIGS. 2 to 5 illustrate one exemplary embodiment of the construction of the control valve device of the invention. The housing 3, as shown in FIGS. 3 and 4, has a multiple-layer construction that consists of a plurality of plates 50 that are connected with one another by soldering or another adhesive substance. The plates 50 include end plates $\mathbf{50}_1$ and $\mathbf{50}_{21}$, between which there are a plurality of intermediate plates $\mathbf{50}_2$ to $\mathbf{50}_{20}$. The end plates $\mathbf{50}_1$ and $\mathbf{50}_{21}$ have a thickness D which is greater than the thickness d of the intermediate plates $\mathbf{50}_2$ to $\mathbf{50}_{20}$.

The delivery channel 8 is formed by recesses that communicate with one another in the end plate $\mathbf{50}_{21}$ and in some of the intermediate plates $\mathbf{50}_2$ to $\mathbf{50}_{20}$. The delivery of channel 8 forms the pump connection P on the recess of the end plate $\mathbf{50}_{21}$. The end plate $\mathbf{50}_{21}$ is thereby provided with a connection device 55 for the delivery line 9, whereby the recess of the end plate $\mathbf{50}_{21}$ can be a threaded boring 56, into which the delivery line 9 can then be screwed. In the same manner, the reservoir channel 12 if formed by recesses that communicate with one another in the end plate $\mathbf{50}_{21}$ and in some of the intermediate plates $\mathbf{50}_2$ to $\mathbf{50}_{20}$. The reservoir channel 12 forms the reservoir connection T at the recess in the end plate $\mathbf{50}_{21}$. In the vicinity of the reservoir connection T, the end plate $\mathbf{50}_{21}$ is provided with a connection device 57 for the reservoir line 14 that leads to the reservoir line 13. For example, the recess of the end plate $\mathbf{50}_{21}$ can be a threaded boring 58, into which the reservoir line 13 can be screwed.

As a result of corresponding recesses that communicate with one another in the end plates $\mathbf{50}_1$ and $\mathbf{50}_{21}$ and the intermediate plates $\mathbf{50}_2$ to $\mathbf{50}_{20}$, a housing boring 60 is formed in which a control spool valve S1 of the control valve 4 is mounted so that it can move longitudinally. In the housing boring 60, a plurality of annular grooves are formed by corresponding recesses in different intermediate plates $\mathbf{50}_2$ to $\mathbf{50}_{20}$, whereby an annular groove located in the central area of the boring 60 is in communication with the pump channel 8. An additional annular groove, which is located next to the annular groove that is in communication with the pump channel 8 forms the connection A1'. Connection A1', which is in communication with the hydraulic channel 15, through the check valve 30, that is the delivery flow sensor 38. The hydraulic channel 15 in the end plate $\mathbf{50}_{21}$ forms the connection A1. In the vicinity of the connection A1, the end plate $\mathbf{50}_{21}$ is provided with a connection device 61 for the hydraulic line 16 that leads to the user 1. The recess in the end plate $\mathbf{50}_{21}$ that is in communication with the hydraulic channel 15 is a threaded boring 62 into which the hydraulic line 16 that leads to the user 1 can be screwed. Additional annular grooves located in the external area of the housing boring 60 are connected in a manner, not shown, to the reservoir channel 12 that is in communication with the reservoir connection T.

In an analogous manner, recesses that are in communication with one another in the end plates $\mathbf{50}_1$, $\mathbf{50}_{21}$ and the intermediate plates $\mathbf{50}_2$ to $\mathbf{50}_{20}$ form a housing boring 65 in which a control spool valve S2 of the control valve 5 is mounted so that it can move longitudinally. In the housing boring 65, there are a plurality of annular grooves formed by corresponding recesses in various intermediate plates $\mathbf{50}_2$ to $50_{20}$. An annular groove located in the central area of the housing boring 65 is in communication with the pump channel 8. Located at some distance on both sides of this annular groove are two annular grooves that form connections A2' and B2', which are connected with the hydraulic channels 19, 20. The hydraulic channels 19, 20 lead, with the interposition of the check valves 31, 32, to the connections A2, B2 formed by the recesses in the end plate $50_{21}$. The hydraulic lines 21, 22 that lead to the user 2 can be connected to connections A2, B2. In the vicinity of the connections A2, B2, the end plate $50_{21}$ is provided with respective connection devices 66, 67 for the hydraulic lines 21, 22 that lead to the user 2. The recesses in the end plate $50_{21}$ that are in communication with the hydraulic channels 19, 20 are each threaded borings 68, 69 into which the hydraulic lines 21, 22 can be screwed. In the outer area of the housing boring 65 there are two additional annular grooves which form reservoir connections T2, and are connected, with the interposition of the delivery flow sensor 39, to the reservoir channel 12.

Also, provided on the end plate $50_{21}$ is a connection flange 74 formed from recesses 70, 71. The recess 70 is connected to the pump channel 8 and forms a pump connection P3, and the recess 71 is connected to the reservoir channel 12 and forms a reservoir connection T3. An additional user can be connected to the control valve device by the connection P3 and the reservoir connection T3. The recesses 70, 71 may be closed by a plug element 72, which is a plate bolted to the end plate $50_{21}$. As a fastening device, a plurality of threaded borings, not described in any further detail, are provided in the vicinity of the connection flange 74. The plug element 72 can be fastened by a plurality of threaded bolts 73 threaded into the threaded borings.

The recess in the end plate $50_{21}$ that forms a portion of the housing boring 60 of the control valve 4 can be closed by a housing cover 80 which simultaneously acts as an abutment for a centering spring device of the control spool valve S1. To fasten the housing cover 80, a fastening device is provided in the end plate $50_{21}$. The fastening device can be, for example, threaded borings that are not illustrated in any further detail, and in which the housing cover 80 can be fastened by threaded bolts 81. The fastening device in the form of threaded borings is thereby located in the vicinity of the flange 85 of the housing cover 80. In the same manner, the housing boring 65 of the control spool valve S2 can be closed by a housing cover 82. To fasten the housing cover 82 in the end plate $50_{21}$, there is a fastening device that consists of a plurality of threaded borings that are located in the vicinity of a flange 86 of the housing cover 82 and in which the housing cover 82 can be fastened by threaded bolts 83.

The check valves 31, 32 are each located so that they can move longitudinally in respective housing borings 90 and 91 formed by recesses communicating with one another in some of the intermediate plates and the end plate $50_{21}$. The housing borings 90, 91 can each be closed by respective closing elements 92, 93. To fasten the closing elements 92, 93 to the housing 3, there are respective fastening devices 94, 95, each of which is formed by a threaded boring 96, 97 in the end plate $50_{21}$ and is connected to the housing borings 90 and 91 respectively. The closing elements 92, 93 are screw plugs which can be screwed into the threaded borings 96, 97 that form the respective fastening devices 94, 95.

To actuate the control spool valves S1, S2 there are respective actuator devices 36, 37, such as stepper motors 100, 101 for example, which are in effective communication with the corresponding control spool valves S1 and S2 of the control valves 4 and 6, respectively. For this purpose, the stepper motors 100, 101 can be in a driving connection with the corresponding control spool valves S1, S2. Through respective gear trains 102, 103. The gear trains 102, 103 can be located in a common transmission housing 104, for example, on which the stepper motors 100, 101 are fastened. Also located in the transmission housing 104 are the pilot valves 33, 34, 35, which can be moved into the open position when the corresponding control spool valve S1, S2 is actuated, to operate the corresponding check valves 30, 31, 32. The actuator devices 36, 37 consist of the transmission housing 104 and the stepper motors 100, 101. To fasten the actuator devices 36, 37 of the control valves 4, 5 to the housing 3, there is a fastening device in the end plate $50_1$, in the vicinity of the flange 106 of the housing 104. The fastening device is a plurality of threaded borings, not shown, in the end plate $50_1$. The actuator devices 36, 37 can be fastened in the threaded borings by threaded bolts 105.

The valve body and the pilot valve 26 of the pressure relief valve 25 are located so that they can move longitudinally in a housing boring 110 that is formed from a recess in the end plate $50_1$ and some of the adjacent intermediate plates $50_2$ to $50_{20}$. On the end plate $50_1$ there is a fastening device in the form of a plurality of threaded borings, which are located in the vicinity of the flange 111. A proportional magnet 112 that actuates the pilot valve 26 of the pressure relief valve 25 can be fastened in the threaded borings by threaded bolts 113.

The delivery flow sensor 39 and the delivery flow sensor 38 that forms the check valve 30 each have a valve body which is mounted so that it can move in a housing boring 115 or 116, which boring is formed from communicating recesses in the end plate $50_1$ and a plurality of adjacent intermediate plates $50_2$ to $50_{20}$. To measure the axial deflection of the valve bodies of the delivery flow sensors 38, 39, there are sensors located in respective sensor housings 117 and 118. The sensor housings 117, 118 are in this case each fastened to the housing 3 by a fastening device 127, 128 located on the end plate $50_1$. For this purpose, the recess 120, 121 in the end plate $50_1$ that belongs to the corresponding housing boring 115, 116 can be threaded borings 122, 123, in which a screw plug 129, 130, which forms the abutment for a spring, can be screwed. On the end plate $50_1$, there are a plurality of threaded borings, in which the sensor housings 117, 118 of the delivery flow sensors 38, 39 can be fastened by threaded bolts 125, 126.

The fastening devices for fastening the actuator devices 36, 37 of the control valves 4, 5, the fastening devices 127, 128 for fastening the delivery flow sensors 38, 39 and the fastening device for fastening the pressure relief valve 25 are thereby located on the end plate $50_1$. The connection device 55 for the delivery line 9, the connection device 57 for the reservoir line 14, the connection devices 16, 21, 22 and the fastening device for the connecting flange 74 of the additional user are located on the end plate $50_{21}$ of the housing 3 opposite the end plate $50_1$. The electrical connections of the actuator devices 36, 37 and of the delivery flow sensors 38, 39 with the electronic control valve device 40 are therefore located on one side of the housing 3, and the hydraulic connection lines of the housing 3 with the pump 10, the reservoir 13, the users 1, 2 and an additional user are located on the opposite side of the housing 3.

On the lateral surfaces of the end plates $50_1$ and $50_{21}$, fastening devices 140, 141 are provided for fastening the control valve device to a valve support, e.g. a vehicle body. The fastening devices 140, 141 can be attached to or shaped onto the corresponding end plates $50_1$ and $50_{21}$. In the exemplary embodiment illustrated, the fastening devices

140, 141 are shaped onto the lateral surfaces of the end plates $\mathbf{50}_1$ and $\mathbf{50}_{21}$, and each have a flange 142 with a boring 143 to hold a threaded bolt.

The specific embodiment described is intended to be illustrative of the present invention and not restrictive thereof. It will be apparent from the foregoing description that various changes may be made to the present invention without departing from the spirit and scope thereof. Consequently, the scope of the present invention is defined by the appended claims and equivalents thereto.

What is claimed is:

1. A control valve device to control the movement of at least one hydraulic user, said device comprising:

a housing, wherein the housing has a multi-layer construction consisting of plates formed of plate-shaped sheets that are connected with one another by one of brazing or soldering, the plates include intermediate plates that are located between two end plates, wherein the thickness of the end plates is greater than the thickness of the intermediate plates and the end plates are provided with fastening devices;

at least one hydraulic line connection device connected to at least one end plate through the fastening devices;

at least one control valve in the housing, each control valve having at least one control spool valve, wherein a relative movement of one control spool valve of one control valve with respect to the housing controls the connection of the at least one hydraulic connection that is in communication with one hydraulic user with a delivery connection and with a reservoir connection; and at least one actuator device attached to at least one of the end plates through the fastening devices, wherein one actuator device is provided for moving one control spool valve relative to the housing actuator device.

2. The control device as claimed in claim 1, wherein the housing includes a pressure relief valve that limits the maximum working pressure of the hydraulic users.

3. The control valve device as claimed in claim 2, wherein the fastening device for the actuator device and the at least one hydraulic line connection device are each in the form of at least one threaded boring located in an end plate.

4. The control valve device as claimed in claim 3, wherein each control spool valve is located in a housing boring formed from recesses in the intermediate plates and the end plates, and wherein a threaded boring is located in a flange of the actuator device that surrounds the recess in an end plate.

5. The control valve device as claimed in claim 1, wherein some of the intermediate plates and at least one end plate are provided with recesses that are in communication with one another and which form a pump channel, a reservoir channel and at least one hydraulic channel, and wherein the recesses located in the end plate are threaded borings.

6. The control valve device as claimed in claim 1, wherein at least one end plate includes at least one fastening device to fasten the control valve device to a control valve support.

7. The control valve device as claimed in claim 6, wherein the control valve fastening device is located on the lateral surface of one end plate.

8. The control valve device as claimed in claims 6, wherein the control valve fastening device is shaped on the end plate.

9. The control valve device as claimed in claim 4, wherein the housing boring of each control spool valve is closed on the side opposite the actuator device with a housing cover, and wherein the end plate opposite the actuator device is provided with a fastening device for the housing cover.

10. The control valve device as claimed in claim 9, wherein the fastening device for the housing cover is at least one threaded boring located in the end plate.

11. The control valve device as claimed in claim 1, wherein at least one additional component is located in a housing boring that is formed from recesses in some of the intermediate plates and at least one end plate, and wherein there is a fastening device for the additional component on at least one end plate.

12. The control valve device as claimed in claim 11, wherein the fastening device for each additional component is a threaded boring located in a recess in the end plate.

13. The control valve device as claimed in claim 11, wherein the fastening device for each additional component is at least one threaded boring located in the flange area of the component in the end plate.

14. The control valve device as claimed in claim 11, wherein the additional component is an electrical component.

15. The control valve device as claimed in claim 1, wherein the actuator device of each control spool valve is an electrical actuator device, wherein the fastening device for the electrical actuator device is located on one end plate and the at least one connection device for the hydraulic lines is located on the opposite end plate.

16. The control valve device as claimed in claim 1, wherein the control valve device actuates the hydraulic work system of an industrial truck.

17. The control valve device as claimed in claim 1, wherein the plates of the housing are connected together by an adhesive.

18. A control valve device to control the movement of at least two hydraulic users, said device comprising:

a housing, wherein the housing has a multi-layer construction consisting of plates formed of plate-shaped sheets that are connected with one another by one of brazing or soldering, the plates include intermediate plates that are located between two end plates, wherein the thickness of the end plates is greater than the thickness of the intermediate plates and the end plates are provided with fastening devices;

at least one hydraulic connection connected to at lest one end plate through the fastening devices;

at least two control valves in the housing, each control valve having at least one control spool valve, wherein a relative movement of one control spool valve of one control valve with respect to the housing controls the connection of the at least one hydraulic connection that is in communication with one hydraulic user with a delivery connection and with a reservoir connection, wherein the multi-layer housing forms a housing block for a plurality of valves; and a plurality of actuator devices attached to at least one of the end plates through the fastening devices, wherein one actuator device is provided for moving one control spool valve relative to the housing actuator device.

19. The control valve device as claimed in claim 18, wherein the housing forms a control for the at least two control spool valves and at least three additional valve bodies.

20. The control valve device as claimed in claim 19, wherein on one end plate there is a connecting flange for the connection of a control valve to control an additional user, wherein the connection flange has a recess that is in communication with a pump channel and one in connection with a reservoir channel, and wherein in the vicinity of the connection flange, at least one fastening device is provided in the form of a threaded boring in the end plate.

* * * * *

UNITED STATES PATENT AND TRADEMARK OFFICE

CERTIFICATE OF CORRECTION

PATENT NO. : 6,394,130 B1
DATED : May 28, 2002
INVENTOR(S) : Horst Deininger

It is certified that error appears in the above-identified patent and that said Letters Patent is hereby corrected as shown below:

Column 6,
Line 48, "which is in communication" should read -- is in communication --.

Column 9,
Line 57, "claimed in claims 6" should read -- claimed in claim 6 --.

Signed and Sealed this

Twenty-ninth Day of October, 2002

*Attest:*

*Attesting Officer*

JAMES E. ROGAN
*Director of the United States Patent and Trademark Office*